US006574167B2

(12) United States Patent
Weissbach et al.

(10) Patent No.: US 6,574,167 B2
(45) Date of Patent: Jun. 3, 2003

(54) CALENDAR MECHANISM FOR A CLOCK WORK

(75) Inventors: Siegfried Weissbach, Schlottwitz (DE); Eberhard Kaden, Schlottwitz (DE)

(73) Assignee: Glashutter Uhrenbetrieb GmbH, Glasshutte/Sachsen (DE)

( * ) Notice: Subject to any disclaimer, the term of this patent is extended or adjusted under 35 U.S.C. 154(b) by 0 days.

(21) Appl. No.: 09/979,216

(22) PCT Filed: Apr. 5, 2001

(86) PCT No.: PCT/EP01/03884

§ 371 (c)(1),
(2), (4) Date: Nov. 21, 2001

(87) PCT Pub. No.: WO01/77756

PCT Pub. Date: Oct. 18, 2001

(65) Prior Publication Data

US 2002/0159337 A1 Oct. 31, 2002

(51) Int. Cl.[7] ..... G04B 19/20; G04B 19/24
(52) U.S. Cl. ..... 368/35; 368/37
(58) Field of Search ..... 368/28, 35–38, 368/223, 232

(56) References Cited

U.S. PATENT DOCUMENTS 3,879,929 A * 4/1975 Charbonney
4,063,411 A * 12/1977 Murrle

* cited by examiner

*Primary Examiner*—Vit Miska
(74) *Attorney, Agent, or Firm*—Sughrue Mion, PLLC

(57) ABSTRACT

Can be mounted in clock mechanisms, especially in the form of a perpetual calendar which is actuated via a wheel of a clock, which wheel performs a revolution in 24 hours, the display being effected separated into units and tens via a printed display disc, which is provided with a toothing, and a program carrier being provided which performs a revolution in 31 days, it is provided that the program carrier (4) actuates additional locking elements in such a manner that, on those days on which the risk of over-rotation exists, they are swung in and out again in the rotational movement of the display discs (2, 3) and correspondingly prevent over-rotation in cooperation with the toothings (9, 16) of the display discs (2, 3).

Figure 1:
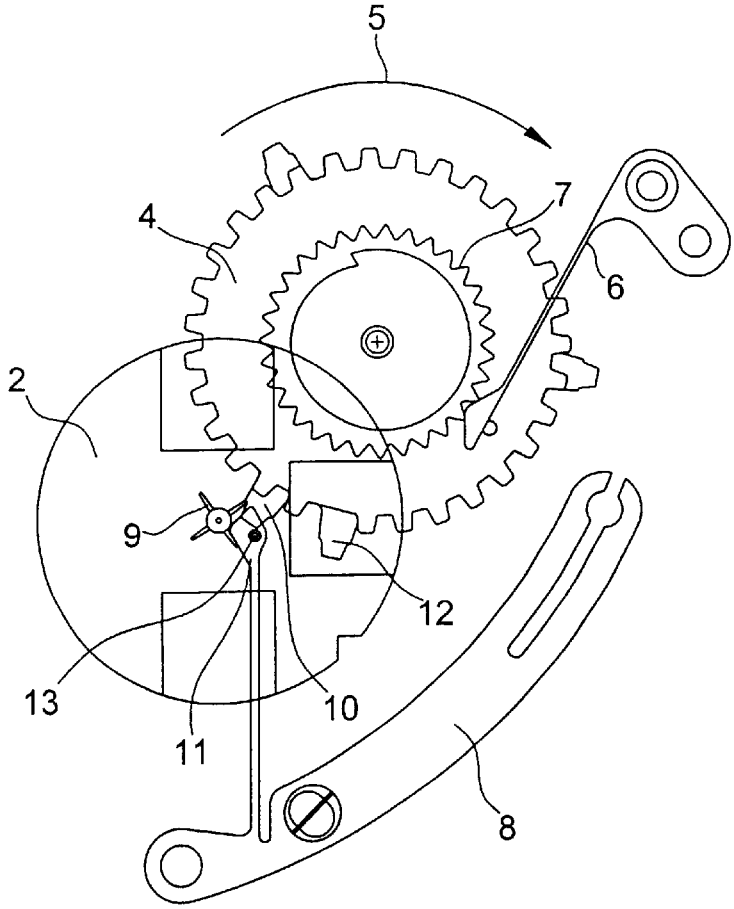
Figure 1:
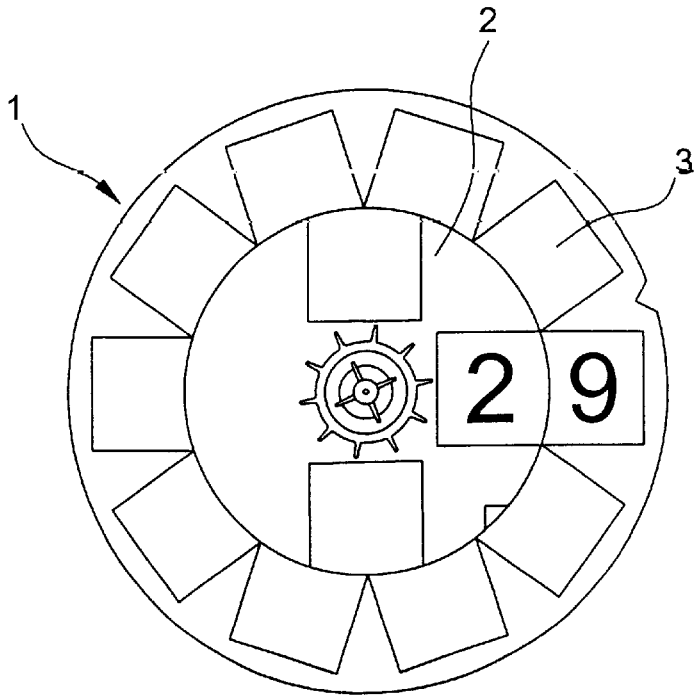

In the case of a calendar mechanism, especially of a modular structure, which.

5 Claims, 7 Drawing Sheets

CALENDAR MECHANISM FOR A CLOCK WORK

The invention relates to a calendar mechanism, especially of a modular structure, which can be mounted in clock mechanisms, especially in the form of a perpetual calendar which is actuated via a wheel of a clock, which wheel performs a revolution in 24 hours, the display being effected separated into units and tens via a printed display disc, which is provided with a toothing, and a programme carrier being provided which performs a revolution in 31 days.

Calendar mechanisms of this type are known with various structures, the date mechanism or date movement being moved on at very low speed via levers and ratchets. In such a mechanism, both daily movement steps and also movement steps covering a plurality of days (from the 30th over the 31st to the 1st in "short" months and from the 28.02 or 29.02 to 01.03) must be produced, which is normally effected via gears with intermittent movement.

For the purpose of adjusting the calendar or for general correction of all the displays, a manual correction button is used which is accessible from outside, said button acting upon the date mechanism via the same levers and ratchets which effect shifting at relatively slow speed in normal operation.

The speeds acting on the mechanism during manual correction diverge individually very greatly. They can achieve dimensions where the catch springs available per se no longer ensure safe stopping of the display discs due to their inertia which is significantly greater in comparison to normal hands so that the result is over-rotation of the display elements.

In order to deal with this problem, one could configure the catch springs, which fix the end position of the movement, with increased elastic force, as a result of which however the torque loading of the clock mechanism increases greatly so that the duration of the action and the precision of the action drop considerably.

Proceeding from here, the object underlying the invention is to configure a date mechanism of the type mentioned initially in such a manner that over-rotation is prevented without the duration and precision of the action being substantially affected.

This object is achieved according to the invention in that the programme carrier actuates additional locking elements in such a manner that, on those days on which the risk of over-rotation exists, they are swung in and out again in the rotational movement of the display discs and correspondingly prevent over-rotation in cooperation with the toothing of the display discs.

According to the invention, the risk of over-rotation by the programme carrier is therefore prevented in that when and only when the corresponding risk exists, an additional locking is provided. On the remaining days, the locking elements do not act upon the date mechanism or the clock mechanism so that the function of the clock mechanism remains completely unaffected other than in the case of an increase in the elastic force of the catch springs.

It can be provided thereby that additional control elements are fitted on the programme carrier or the control elements are produced by the configuration of the programme carrier, the control elements respectively actuating the locking elements.

It is provided in a further embodiment of the invention that the additional locking element is a ratchet which can be pivoted about a pivot bearing axis, said ratchet being retained out of engagement relative to the toothing of the display disc by means of a spring in the non-locking period of time.

It is provided in another embodiment according to the invention that one of the catch springs carries a pin as locking element which cooperates with the programme carrier, and the bending point of which springs is positioned such that the pin describes a track which enables a locking and detaching function.

Figure 5:
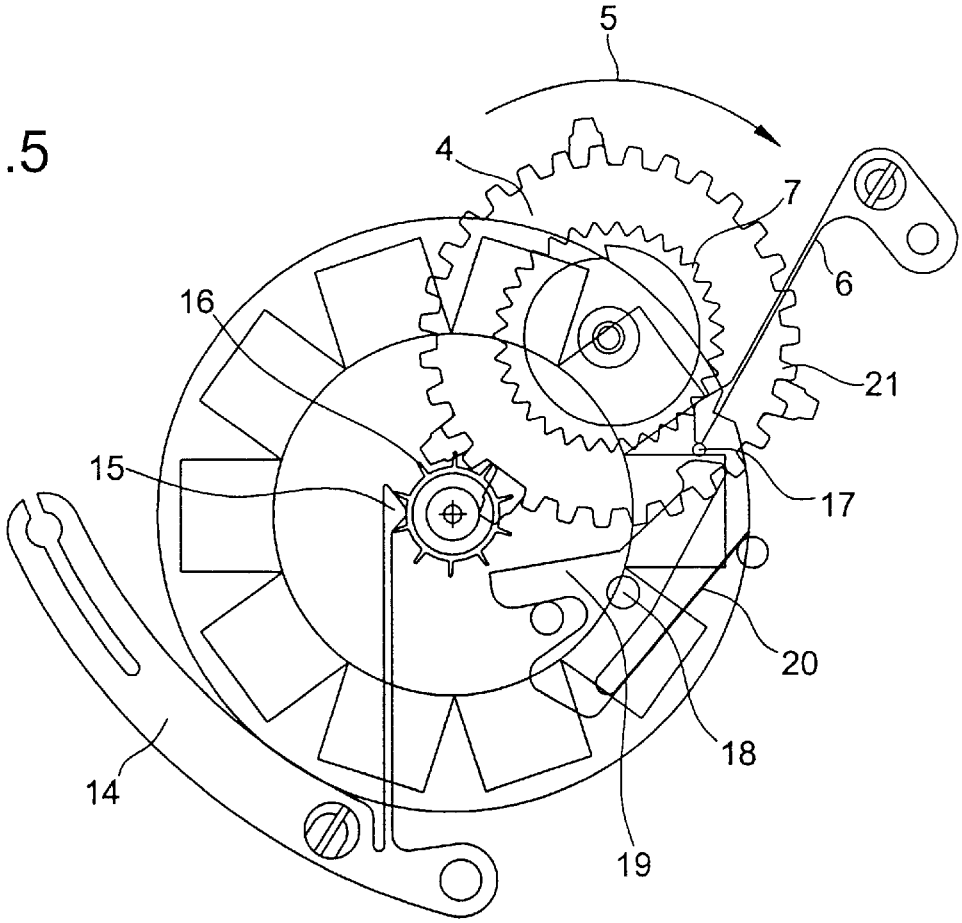
Figure 5:
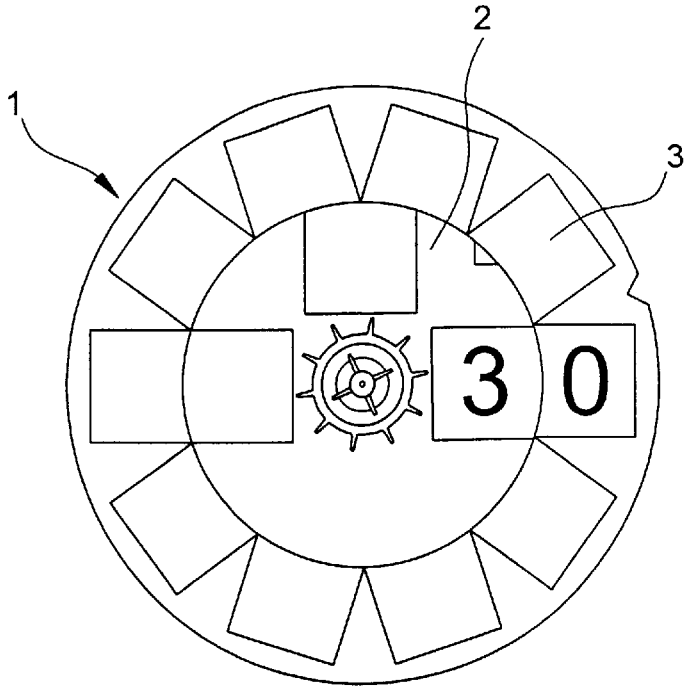
Figure 6:
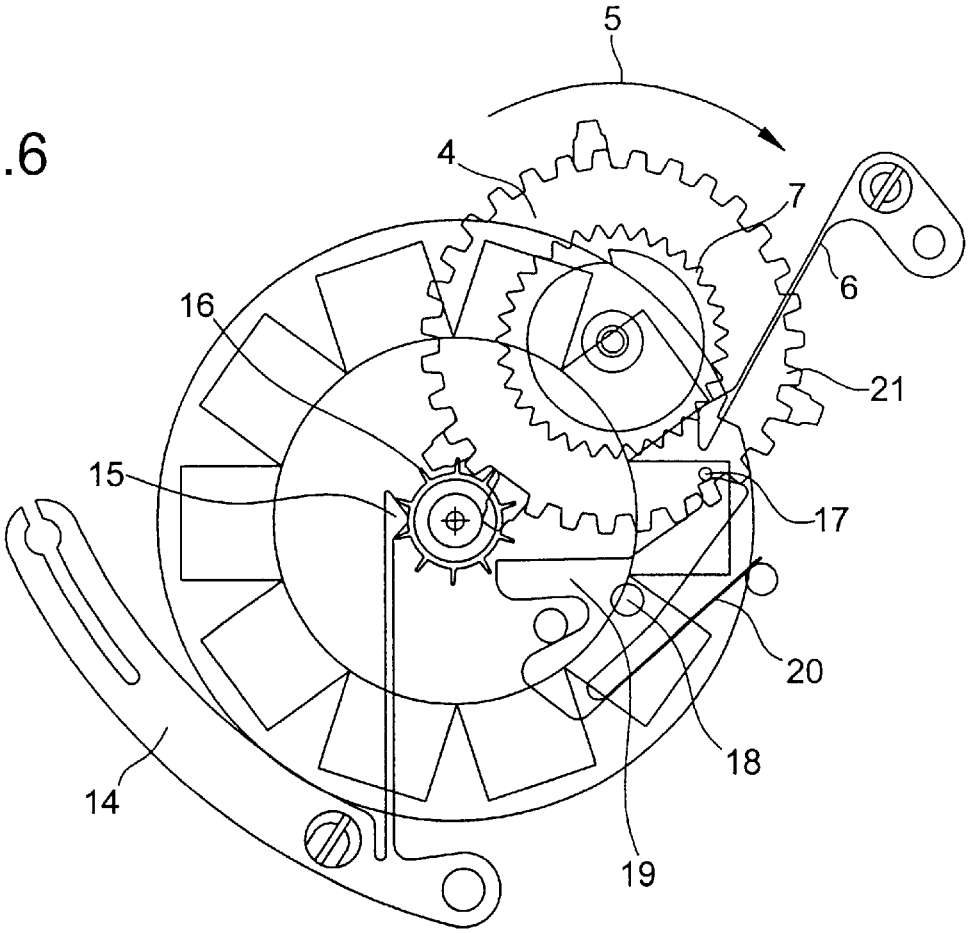
Figure 6:
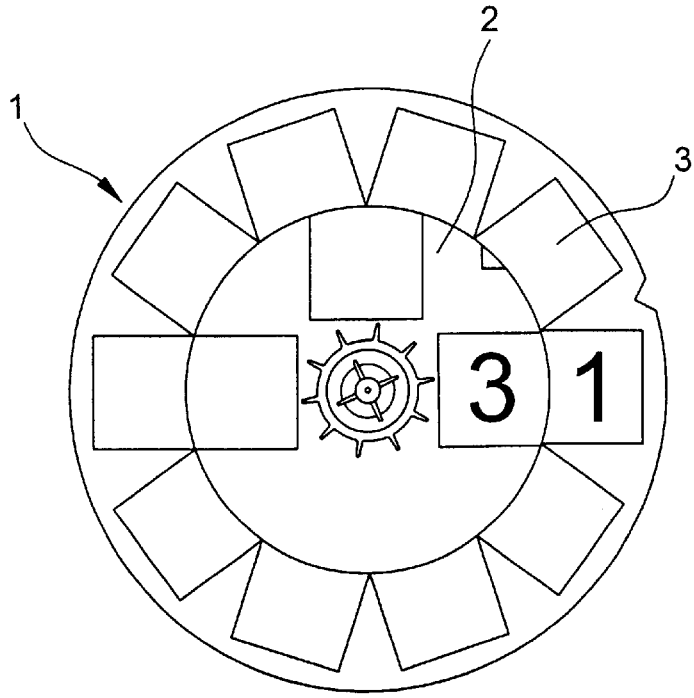
Figure 7:
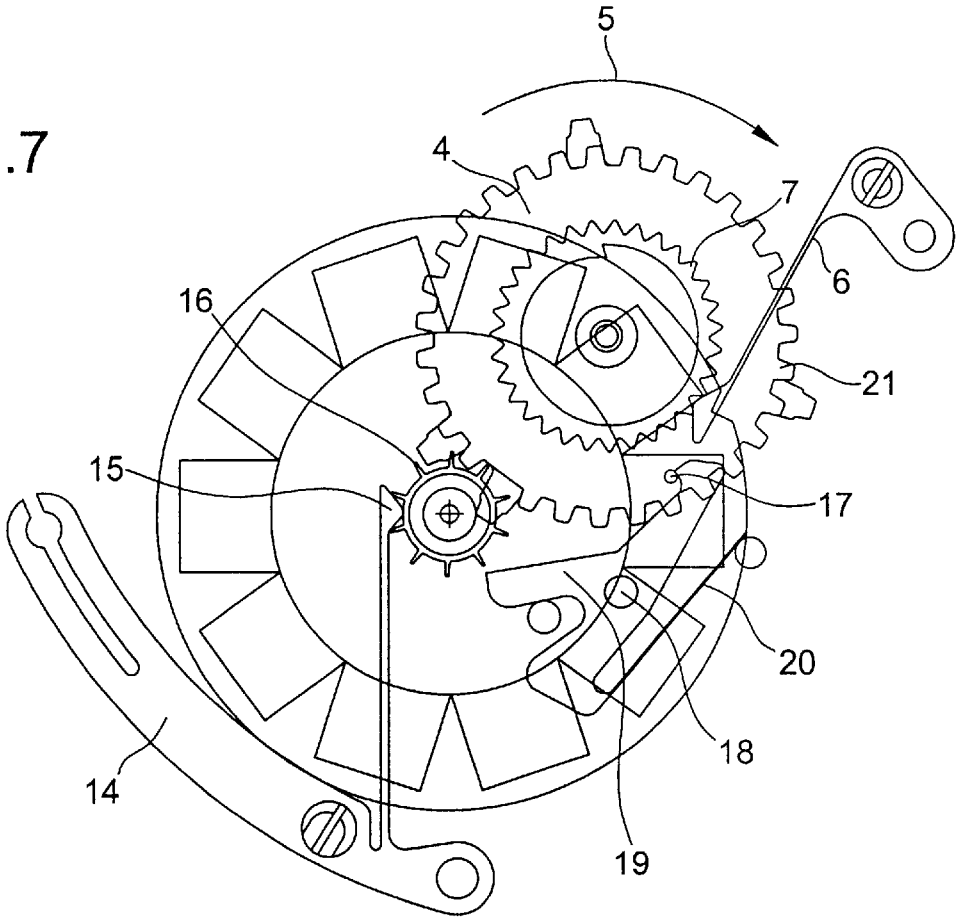
Figure 7:
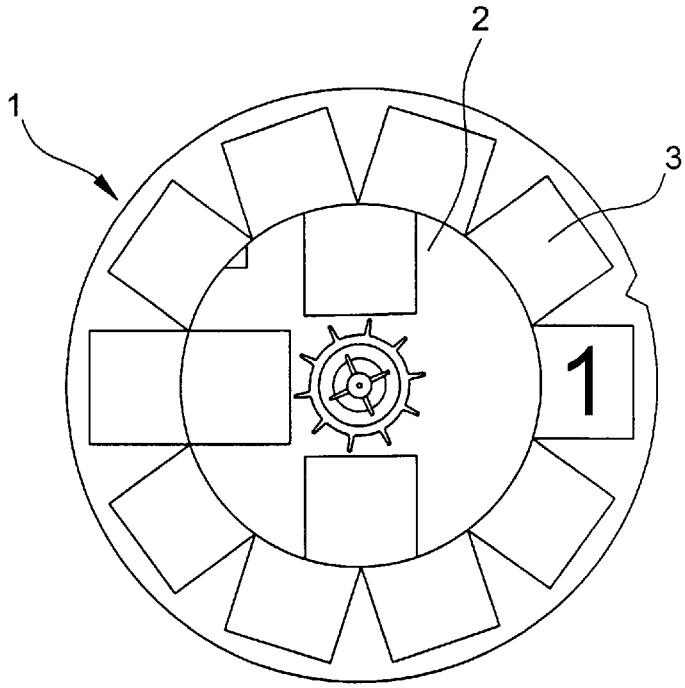

The invention is described in more detail subsequently with reference to preferred embodiments, given by way of example, in conjunction with the drawings, which show:

FIGS. 1 to 4 the parts of the date mechanism, which are essential for the invention, with the respectively associated view of the display discs in four phases following upon each other temporally upon switching of the tens from the 29th to the 30th and FIGS. 5 to 7 corresponding illustrations of the switching of the units from the 30th to the 1 st in short months.

A date display 1 according to the invention, illustrated in FIGS. 1 to 7 comprises two display discs 2 and 3, which are disposed concentrically relative to each other and actuated, the former being for the tens and the latter for the units of the respective day in the month.

A programme carrier 4 which is known per se, moves in the direction of the arrow 5 in such a manner that it performs a revolution in 31 days. A catch spring 6 is assigned in a manner known per se to the programme carrier 4 and cooperates with a toothing 7 of the programme carrier 4.

According to the invention a further catch spring 8 is provided, the catch head 11 of which acts upon a pinion which is connected to the display disc 2 and has 4 teeth 9, as is illustrated in FIG. 1.

By means of a further radially projecting control element 10 of the programme carrier 4, the pinion 9 is rotated further, the catch spring 8 or its catch head 11 being brought out of engagement.

Figure 2:
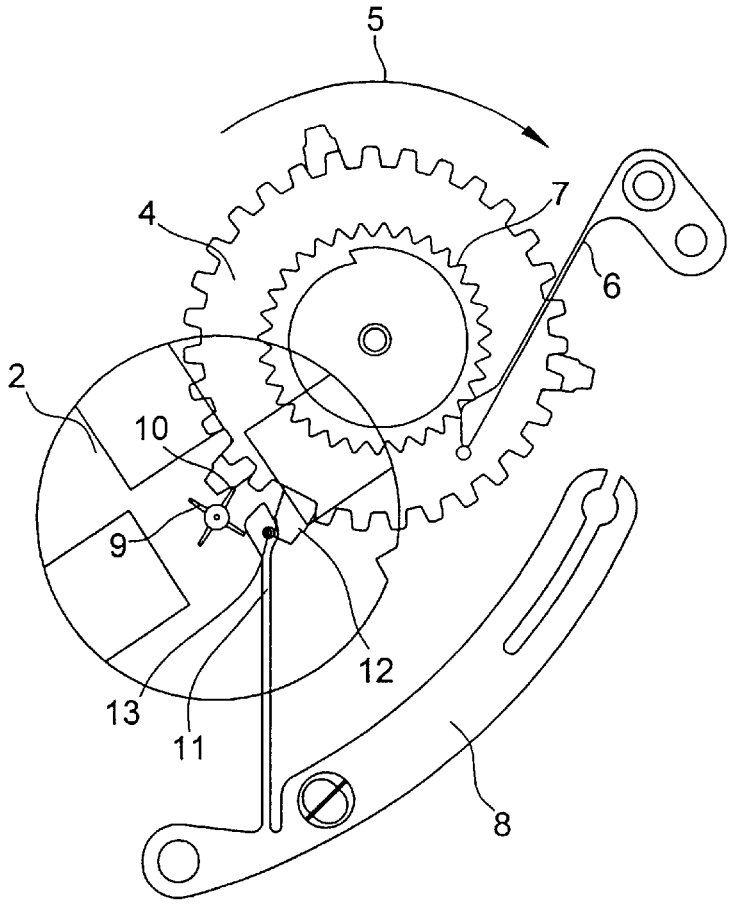
Figure 2:
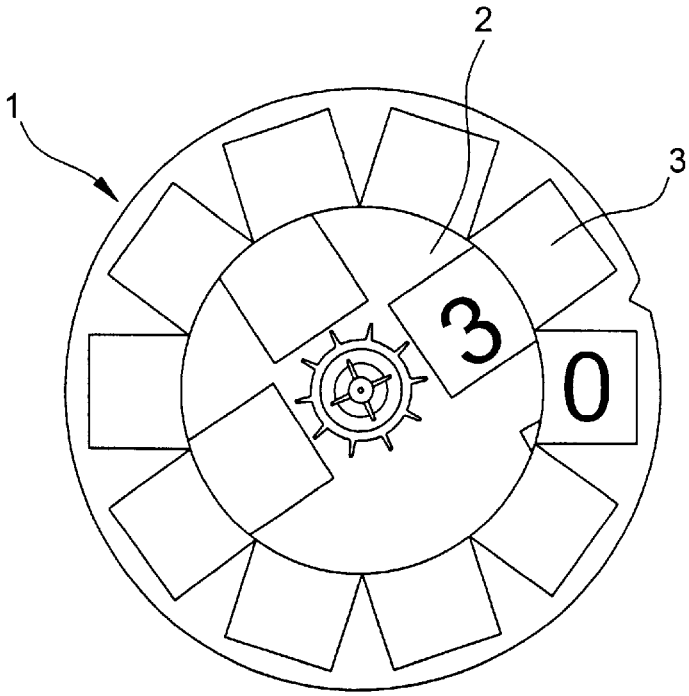

Because of the inertia of the display disc 2, the next tooth of the pinion 9 is placed against the rear flank of the radial control element 10 and moves further out beyond the provided catch position (FIG. 2).

Figure 3:
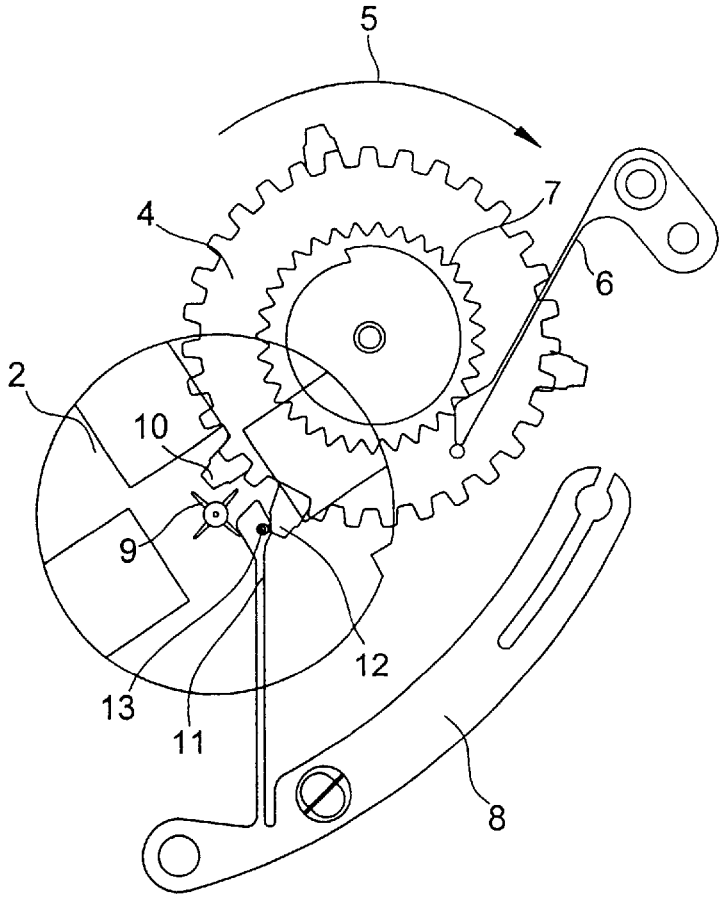
Figure 3:
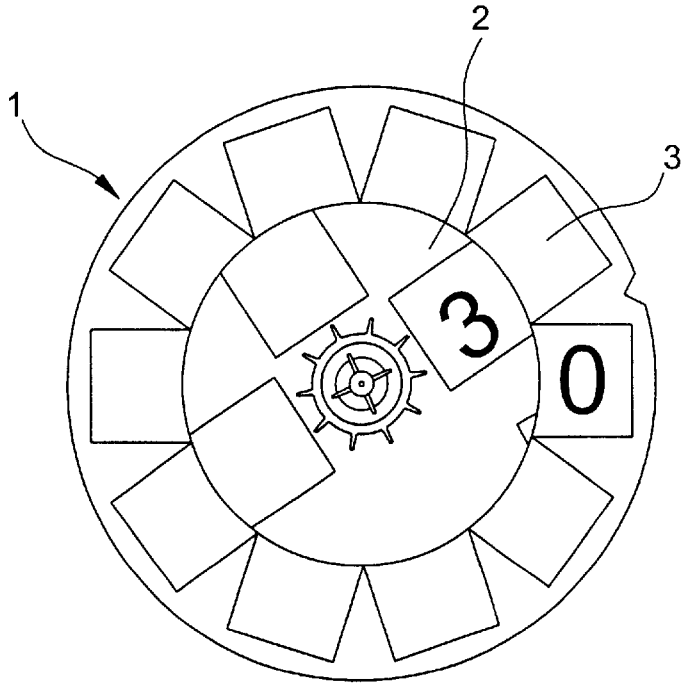
Figure 4:
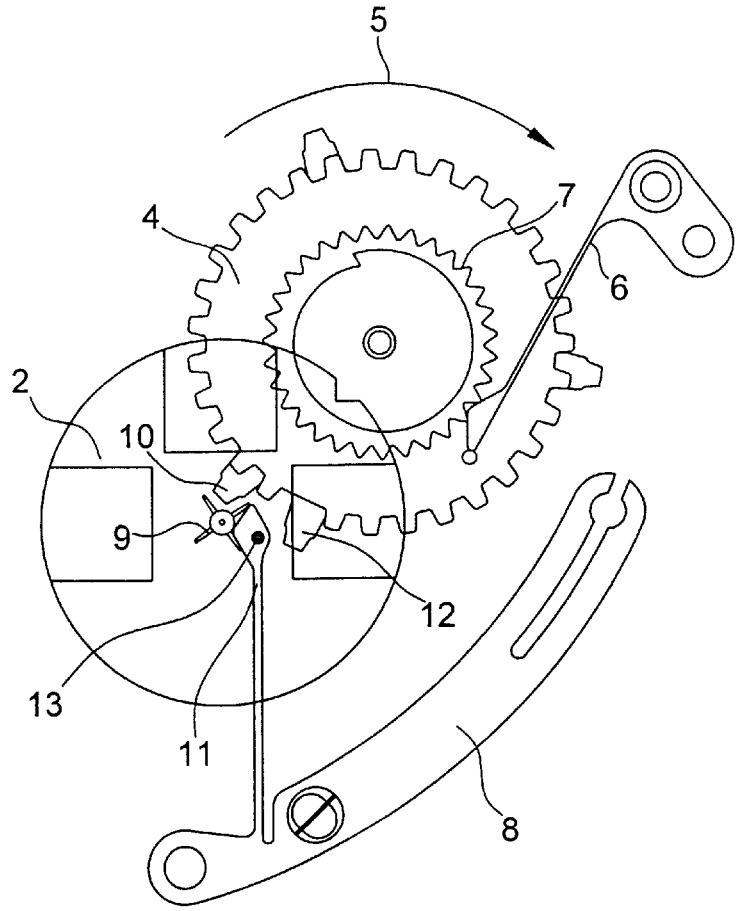
Figure 4:
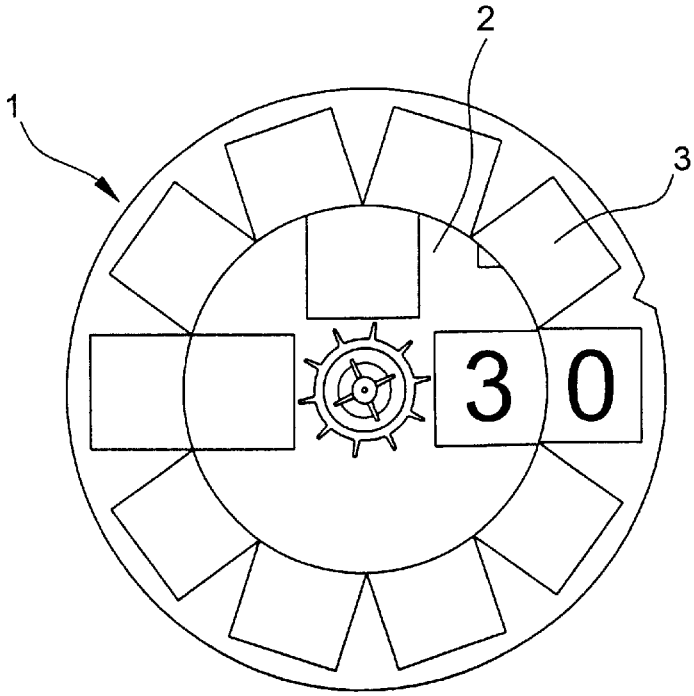

Before the catch spring 8 or its catch head 11 comes into the next gap of the pinion 9 and hence into a catch position, which corresponds to the following day (and hence incorrect day), a further radially projecting control element 12 of the programme carrier 4 comes into operation with a pin 13 which protrudes from the catch head 11 of the catch spring 8, and pushes the catch head 11 into the gap of the pinion 9, which gap corresponds to the correct day, and thus blocks the rotational movement of the pinion 9 connected to the display disc 2 (FIG. 3). The catch spring 8 can lock fully in the gap of the pinion after the rotational movement of the pinion 9 has stopped and can adopt a catch position which corresponds to that illustrated in FIG. 2. By means of corresponding positioning of the bending point of the catch spring 8, the pin 13 thereby moves in such an orbit that, shortly after producing the blocking function, it again leaves the orbit of the control element 12 and does not affect the further movement of the display disc.

According to the invention, a further catch spring 14 is provided, the catch head 15 of which acts upon a pinion with ten teeth, which pinion is connected to the display disc 3, as is illustrated in FIG. 5.

The programme carrier 4 carries a pin 17 which protrudes axially as control element, which pin can cooperate for its part with a ratchet 19 which can be rotated about the pivot bearing axis 18. The ratchet 19 is deflected under the effect of the formed spring 20 in such a manner that its tip is retained out of engagement relative to the pinion 16 as long as the pin 17 does not touch the ratchet 19.

When switching from the 30th over the 31st to the 1st, the toothing 21 of the programme carrier 4 firstly rotates the pinion 16 further and hence the unit disc by one division so that the display changes from 0 to 1. At the same time, the pin 17 runs against the ratchet 19, pivots the latter such that its tip plunges into the toothing of the pinion 16 and prevents the display disc 3 from rotating through (FIG. 6). Upon further rotation of the programme carrier 4, the ratchet 19 drops again from the pin 17, the tip of which goes out of engagement relative to the pinion 16 and the programme carrier can complete the step from the 31st to the 1st without the display disc 3 being moved (FIG. 7).

What is claimed is:

1. Calendar mechanism, especially of a modular structure, which can be mounted in clock mechanisms, especially in the form of a perpetual calendar which is actuated via a wheel of a clock, which wheel performs a revolution in 24 hours, the display being effected separated into units and tens via printed display discs, which is provided with toothings, and a programme carrier being provided which performs a revolution in 31 days, characterised in that the programme carrier (4) actuates additional locking elements (13, 19) in such a manner that, on those days on which the risk of over-rotation exists, they are swung in and out again in the rotational movement of the display discs (2, 3) and correspondingly prevent over-rotation in cooperation with the toothings (9, 16) of the display discs (2, 3).

2. Calendar mechanism according to claim 1, characterised in that an additional control element (17) is fitted on the programme carrier (4).

3. Calendar mechanism according to claim 1, characterised in that the control elements are produced by the configuration of the programme carrier.

4. Calendar mechanism according to claim 2, characterised in that the control elements (10, 12, 17) drive the locking elements (11, 13, 19).

5. Calendar mechanism according to claim 1, characterised in that one of catch springs (8) carries a pin (13) as the locking element which cooperates with the programme carrier (4) and the bending point of which springs is positioned in such a manner that the pin (13) describes a track which enables a locking and detaching function.

* * * * *